United States Patent [19]

Buckley et al.

[11] 4,055,418

[45] Oct. 25, 1977

[54] MIGRATION IMAGING METHOD USING AN IMAGING MEMBER EMPLOYING A SURFACE SKIN

[75] Inventors: David A. Buckley, Rochester; Frank G. Belli, Webster, both of N.Y.

[73] Assignee: Xerox Corporation, Stamford, Conn.

[21] Appl. No.: 598,311

[22] Filed: July 23, 1975

Related U.S. Application Data

[62] Division of Ser. No. 499,716, Aug. 22, 1974, Pat. No. 3,979,210.

[51] Int. Cl.[2] ..... G03G 13/048

[52] U.S. Cl. ..... 96/1 PS; 96/1 M; 96/1.4; 156/344; 427/155; 264/DIG. 47

[58] Field of Search ..... 96/1 PS, 1 M, 1.4, 83; 156/344; 264/130, DIG. 47; 428/352; 427/155

[56] References Cited

U.S. PATENT DOCUMENTS

| | | | |
|---|---|---|---|
| 3,236,677 | 2/1966 | Bradstreet | 428/352 |
| 3,258,336 | 6/1966 | Ewing | 96/83 X |
| 3,549,360 | 12/1970 | O'Neill et al. | 264/130 X |
| 3,549,447 | 12/1970 | Bresnick | 96/1.4 X |
| 3,690,909 | 9/1972 | Finley | 427/155 X |
| 3,741,757 | 6/1973 | Goffe | 96/1 PS |
| 3,794,546 | 2/1974 | Cohen et al. | 156/344 |
| 3,801,314 | 4/1974 | Goffe | 96/1 PS |
| 3,836,364 | 9/1974 | Lin | 96/1.4 |
| 3,909,262 | 9/1975 | Goffe et al. | 96/1 PS X |
| 3,926,626 | 12/1975 | Bean | 96/1 PS X |

*Primary Examiner*—Edward C. Kimlin
*Assistant Examiner*—Judson R. Hightower

[57] ABSTRACT

An imaging method is disclosed comprising providing an imaging member comprising a first layer of softenable material containing migration material overlying a second layer of softenable material which is substantially free of migration material wherein at least one of the layers of softenable material contains a surface skin located at the interface between the layer of softenable material. This member is latently imaged and developed by softening whereby the migration material migrates through the first layer of softenable material and the interface, where the surface skin is located, and in depth in the second layer of softenable material thereby forming an imaged member. Background of the migration material is then removed from the imaged member by splitting the member at the interface thereby obtaining an image with excellent imaging properties.

3 Claims, 14 Drawing Figures

MIGRATION IMAGING METHOD USING AN IMAGING MEMBER EMPLOYING A SURFACE SKIN

This is a division, of application Ser. No. 499,716 filed Aug. 22, 1974, now U.S. Pat. No. 3,979,210.

BACKGROUND OF THE INVENTION

This invention relates generally to migration imaging systems and more specifically, to a process of splitting an imaged migration imaging member at an interface between a first layer of softenable material containing unmigrated migration material, i.e., background material, overlying a second layer of softenable material containing migration material in image configuration. At least one of the softenable layers contains a surface skin at the interface between the softenable layers. When the imaged member is split at this interface, where the surface skin is located, an unexpected improvement in image resolution and diffuse contrast density is obtained as compared with images produced by splitting similar two-layer structures which do not contain surface skins.

A migration imaging system capable of producing high quality images of high density, continuous tone and high resolution has been developed. Such imaging systems are disclosed in copending U.S. patent application Ser. No. 837,780, now U.S. Pat. No. 3,975,195, and Ser. No. 837,591, both filed June 30, 1969, both of which the entire contents of which are hereby incorporated herein by reference. In a typical embodiment of these migration imaging systems, an imaging member comprising a substrate, a layer of softenable material containing electrically photosensitive migration material is latently imaged, e.g., by electrically charging the member and exposing the charged member to a pattern of activating electromagnetic radiation, such as light. When the photosensitive migration material is originally in the form of a fracturable layer located at the upper surface of the softenable material, particles of the migration material in the exposed areas of the migration member migrate toward the substrate when the member is developed by decreasing the resistance of the softenable layer sufficient to allow migration of the migration material in depth in the softenable material. When the photosensitive material is originally dispersed throughout the layer of softenable material, particles of the migration material in the unexposed areas of the migration member migrate toward the substrate when the member is developed by decreasing the resistance of the softenable layer sufficient to allow migration of the migration material in depth in the softenable material.

Various modes for developing, i.e., softening the softenable material sufficient to allow migration of the migration material in depth in the softenable material, are known. These various development modes include, e.g., softening by liquid solvents, solvent vapors, heat and combinations thereof, as well as other methods of softening the softenable material to allow migration of the migration material in depth in the softenable material, as disclosed in both Ser. No. 837,780, now U.S. Pat. No. 3,975,195, and Ser. No. 837,591.

The imaging systems disclosed in copending application Ser. No. 460,377, filed June 1, 1965, now U.S. Pat. No. 3,520,681, the entire contents of which are hereby incorporated herein by reference, generally comprises the combination of process steps which include forming a latent image on a migration imaging member and developing with solvent liquid or vapor or heat or combinations thereof, to render the latent image visible. In certain methods of forming the latent image, nonphotosensitive or photosensitively inert, fracturable layers and particulate material may be used to form images, as described in copending applcation Ser. No. 583,675, filed Aug. 30, 1965, now U.S. Pat. No. 3,466,963, the entire contents of which are hereby incorporated herein by reference, wherein a latent image is formed by a wide variety of methods including charging in imagewise configuration through the use of a mask or stencil; first forming such a charge pattern on a separate photoconductive insulating layer according to conventional xerographic reproduction techniques and then transferring this charge pattern to the imaging member by bringing the two layers into very close proximity and utilizing breakdown techniques as described, for example, in Carlson, U.S. Pat. No. 2,982,647 and Walkup, U.S. Pats. Nos. 2,825,814 and 2,937,943. In addition, charge patterns conforming to selective, shaped electrodes or combinations of electrodes may be formed by the "TESI" discharge technique as more fully disclosed in Schwertz, U.S. Pats. Nos. 3,023,731 and 2,919,967 or by the techniques described in Walkup, U.S. Pat. No. 3,001,848 and 3,001,849 as well as by electron beam recording techniques, for example, as disclosed in Glenn, U.S. Pat. No. 3,113,179.

U.S. Pat. No. 3,741,757 discloses providing an imaged member comprising a layer of softenable material and migration material selectively distributed in depth in the softenable material in first image configuration and comprising in addition to said first image pattern of migration material, a background of substantial amounts of migration material in the softenable material but spaced apart in depth from the first image pattern and then removing the background. A specifically preferred embodiment is removing the background of migration material by splitting the softenable layer on an average in a plane substantially between the image pattern configuration of migration material and the background of migration material. Also disclosed in U.S. Pat. No. 3,741,757 is a preferred strip-splitting technique which also substantially simultaneously accompanies migration development of a latent image, i.e., applying a migration force to the migration layer of a migration imaging member sufficiently to cause migration of the migration material in image configuration and then developing the member by softening the softenable material with, for example, softening liquid for the softenable layer whereby the migration material migrates in image configuration. Then the stripping member is placed against a free surface of the softenable layer and then stripped apart to create a complementary positive and negative split image. While U.S. Pat. No. 3,741,757 discloses mainly layer configuration migration imaging members as described in U.S. patent application Ser. No. 725,676, now abandoned, U.S. Pat. No. 3,741,757 also discloses binder configuration migration imaging members as described in copending application Ser. No. 634,757, filed Apr. 28, 1967, now abandoned.

It has recently been discovered that an image may be produced by splitting which has unexpected improved properties, e.g., resolution and diffuse contrast density, when a new migration imaging member, comprising a first layer of softenable material containing migration material overlying a second layer of softenable material which is substantially devoid of migration material and at least one of the softenable layers contains a surface skin at the interface between the first and second layers of softenable material, is developed by migration imaging to form a migration imaged member comprising a first layer of softenable material containing background material, i.e., unmigrated migration material, overlying a second layer of softenable material containing imagewise migrated migration material, i.e., the migrated image, and at least one of the softenable layers containing a surface skin at the interface between the first and second layers of softenable material. The imaged member is split at the interface, where the surface skin is located, resulting in the background being removed producing an image which unexpectedly has superior properties as compared to images formed when a double layered member similar to the above members, except not containing surface skins at the interface, is split in the same manner.

SUMMARY OF THE INVENTION

It is, therefore, an object of this invention to provide a new migration imaging member.

It is a further object of this invention to provide a new imaged migration imaging member.

It is a further object of this invention to provide a method of splitting a new imaged migration imaging member removing the background thereby producing an image with unexpected improved properties.

The foregoing objects and others are accomplished by providing a migration imaging member comprising a first layer of softenable material containing migration material overlying a second layer of softenable material which is substantially devoid of migration material. At least one of the layers of softenable material contains a surface skin which is located at the interface between the two layers of softenable material and at the entire surface of at least one of the layers of softenable material. An electrical latent image is formed on the migration imaging member. The member is developed by softening both the first and second layers of softenable material at least sufficient to allow migration of migration material in both of the layers of softenable material. As a result of the development step, the migration material migrates in image configuration through the first layer of softenable material and through the interface, where the surface skin is located, and in depth in the second layer of softenable material. The background of migration material is then removed by splitting the member at the interface, where the surface skin is located, whereby the splitting removes background material and yields images of unexpected increased resolution and diffuse contrast density.

BRIEF DESCRIPTION OF THE DRAWINGS

For a better understanding of the invention and other objects and further features thereof, reference is now made to the following detailed disclosure of this invention taken in conjunction with the accompanying drawings wherein.

DESCRIPTION OF THE PREFERRED EMBODIMENTS

Figure 1A:
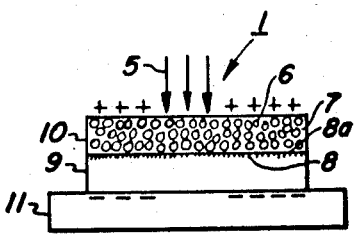
FIG. 1A is a partially schematic drawing representing forming a latent image on a binder configuration migration imaging layer, i.e., a layer of softenable material with migration material dispersed throughout, which overlies a second softenable layer which is substantially devoid of migration material and which contains a surface skin at the interface between the binder layer and the second softenable layer.

Referring now to FIG. 1A which shows a schematic drawing of one of the embodiments which comprises imaging member 1 which comprises a first layer of softenable material 10 which contains migration material 6 dispersed throughout softenable layer 10. Softenable layer 10 overlies softenable layer 9 which is substantially devoid of any migration material and which contains a surface skin 8 located at interface 8*a*. Interface 8*a* is located between softenable layer 10 and softenable layer 9. The second softenable layer 9 overlies substrate 11.

A latent image may be formed on imaging member 1 by the optimum electrical-optical mode hereof where migration material 6 is photosensitive material by a preferred method comprising the steps of uniformly charging the surface of imaging member 1 with a corotron device and imagewise exposing. In FIG. 1A, the imaging member is uniformly electrostatically charged positive, for example, by means of a corotron charging device which may transverse the member from left to right depositing a uniform positive charge. Charging techniques and other corona charging devices are described in copending application Ser. No. 837,780, filed June 30, 1969, now U.S. Pat. No. 3,975,195. A second step in the embodiment of the optimum electrical-optical mode of forming the latent image after charging member 1, is exposing member 1 to an imagewise pattern of activating radiation 5. For purposes of illustration, the surface electrical charges in the exposed areas have been shown as discharged by normal xerographic techniques. A detailed description of more optimum processes of forming latent images is described in copending U.S. patent application Ser. No. 837,591, filed June 30, 1969.

Softenable layers 9, 10 and 13 may be any suitable softenable material, typically a plastic or thermoplastic material which is capable of being softened sufficiently to allow migration of the migration material through softenable layers 10 and 13 and interface 8*a,* i.e., where surface skin 8 is located, and in depth in softenable layer 9. The softenable material should be capable of being softened in a solvent liquid, solvent vapor, heat or combinations thereof. Preferably, the softenable material should have a softening range of about 10° C. and an initial softening point less than about 90° C. and a surface melt viscosity of about $10^4$ to $10^9$ poise.

"Softenable" as used to depict softenable layers 9, 10 and 13, is intended to mean any material which can be rendered by the development step thereof, i.e., softenable step, more permeable to particles migrating through its bulk.

Typically preferred substantially electrically insulating softenable materials include a host of plastic and themoplastic materials, examples of which are specifically recited in copending application Ser. No. 837,780, now U.S. Pat. No. 3,975,195, and Ser. No. 837,591, both filed June 30, 1969, both of which the entire contents of which are hereby incorporated herein by reference. Paraffins and waxes and other materials which are typically substantially electrically insulating and capable of being softened sufficiently to allow migration of migration material, may be used in the advantageous system of the present invention. Such substantially electrically insulating softenable materials will typically have resistivities not less than about $10^{10}$ ohms-cm., and preferably have resistivities not less than about $10^{12}$ ohms-cm.

Specifically preferred substantially electrically insulating materials include copolymers of styrene and hexylmethacrylate; copolymers of styrene and n-butylmethacrylate; copolymers of styrene and octyl-acrylate; copolymers of styrene and p-decyl-styrene and copolymers of methyl methacrylate and p-decyl-styrene.

Softenable layers 9, 10 and 13 may be of any suitable thickness. However, softenable layer thicknesses from about ½ to about 16 microns are found to be preferred.

Still another embodiment, the softenable material, may itself be electrically photosensitive or photoconductive; such softenable materials in imaging systems utilizing such materials are fully described in copending application Ser. No. 837,591, filed June 30, 1969, the entire contents of which are hereby incorporated herein by reference.

Typical binder configuration migration imaging members are illustrated by softenable layer 10 which has migration material 6 dispersed throughout, are disclosed in copending U.S. patent application Ser. No. 837,591, filed June 30, 1969, the entire contents of which are hereby incorporated herein by reference.

Migration particles 6 may comprise any suitable material which is typically not readily soluble in any of the media used to soften the softenable layer during development of the migration imaging member. Preferably, materials in particle form should be about 0.01 to about 3 microns in size and optically about 0.5 to about 1 micron in size for optimum resolution and otherwise high quality images according to this invention.

Migration material 6 may be selected from an extremely broad group of materials and mixtures thereof including electrically conductive materials, insulating materials, partially electrically conductive materials, electrically photosensitive materials, photosensitively inert materials, or any other materials having any other suitable physical characteristics. A host of suitable materials are described in copending application Ser. No. 837,591, filed June 30, 1969.

Softenable layer 9 may contain a surface skin layer 8 which is located at interface 8*a* between softenable layers 10 and 9. Surface skin 8 may typically be formed by changing the properties of the surface of softenable layer 9 in situ. Surface skin 8 may be of a higher viscosity material than softenable layer 9 which is formed on the surface of softenable layer 9 by modification of the surface of softenable layer 9. Softenable layer 9 may contain surface skin 8 on at least one entire free surface of softenable layer 9 and this surface skin may be formed by exposing the free surface of softenable layer 9 to hardening radiation sufficiently to form surface skin 8. Surface skin 8 may have a thickness from about 0.01 to about 0.5 micron and more preferably, a thickness from about 0.01 to about 0.2 micron.

Typical methods for forming surface skin layer 8 include exposure of the surface of softenable layer 9 before softenable layer 10 is fabricated thereon to actinic light, x-rays, beta rays, gamma rays, electrical bombardment, corona charging, high voltage discharge, exposure to visible light, exposure to air, contact with chemical means such as oxidizing agents and/or linking agents, or any other reactive means capable of forming the surface skin layer having a viscosity greater than the viscosity of the bulk of the softenable layer 9.

Figure 3:
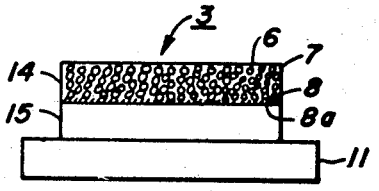
FIG. 3 is a partially schematic drawing representing an overlayer of softenable material containing a dispersion of migration material overlying a second layer of softenable material which is substantially devoid of migration material. The first layer of softenable material contains a surface skin located at the interface between the first and second layers of softenable material.
Figure 4:
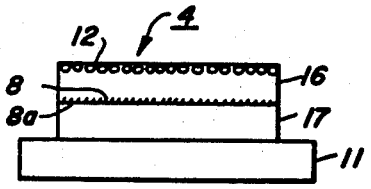
FIG. 4 is a partially schematic drawing representing a member containing a first layer of softenable material which contains a layer of migration material overlying a second layer of softenable material which is substantially devoid of migration material. The first layer of migration material contains a surface skin at the interface between the first and second layers of softenable material.

In another embodiment, the surface skin layer may be located on the surface of softenable layer 14 or softenable layer 16 as illustrated in FIGS. 3 and 4 respectively, and at the interface between softenable layer 14 and softenable layer 15, as illustrated in FIG. 3, or at the interface between softenable layer 16 and softenable layer 17, as illustrated in FIG. 4.

Substrate 11 may be electrically conductive or insulating. Also, substrate 11 may be photosensitive or nonphotosenstive. Conductive substrates generally facilitate the charging or sensitizing of the member and typically may be of copper, brass, nickel, zinc, chromium, stainless steel, conductive plastics and rubbers, aluminum, steel, cadmium, silver, gold or paper rendered conductive by the inclusion of a suitable chemical therein or through conditioning in a humid atmosphere to insure the presence therein of sufficient water content to render the material conductive. Suitable substrates are disclosed in copending U.S. patent application Ser. No. 837,780, filed June 30, 1969, the entire contents of which are hereby incorporated herein by reference. The electrically insulating substrate materials will typically have resistivities of not less than about $10^{12}$ ohms-cm. or resistivities not less than about $10^{14}$ ohms-cm. However, materials having lower resistivities will perform satisfactorily in various embodiments hereof. Supporting substrate 11 is preferably partially or substantially translucent or transparent where the imaging member is being viewed with transmitted light. In some embodiments, substrate 11 may comprise a more electrically insulating material or have a more electrically conductive material coated thereon at the interface between substrate 11 and softenable layer 9, so that the coated substrate functions as an electrically conductive substrate.

Although the migration imaging members described in FIG. 1A, FIG. 2A, FIG. 3 and FIG. 4 are shown on supporting substrate 11, it will be appreciated that in various modes of the inventive imaging system the softenable layers may themselves be sufficiently self-supporting to allow their preparation and imaging separate from a substrate. Such self-supporting imaging members may be imaged by processes involving selectively softening only portions of the area or thickness of the softenable material while the unsoftened portions thereof maintain sufficient integrity to continue to support the member. Typically, the imaging member may be placed in contact with a suitable desired substrate before or during the migration imaging process.

In fabricating the member illustrated in FIG. 1A, the first softenable layer 9, which is typically free or void of migration material, is overcoated on substrate 11 and then surface skin 8 is formed thereon and then a second softenable layer 10, having migration material dispersed throughout, is coated on layer 9

FIG. 1A also illustrates the optimum charge-exposed mode of forming an electrically latent image on an imaging member. In FIG. 1A imaging member 1 is electrically charged with an electrical charging device such as a corotron charging device, which may be passed adjacent the surface of the imaging member. In FIG. 1A the charged imaging member is shown being imagewise exposed to activating electromagnetic radiation areas 5. Upon imagewise exposure, the electrically photosensitive material of the present invention apparently discharges in the exposed areas and remains charged in the unexposed areas. A detailed description of more optimum processes of forming the latent images are described in copending U.S. patent application Ser. No. 837,591, filed June 30, 1969, the entire contents of which are hereby incorporated herein by reference.

After the electrical latent image is formed, the latently imaged member is developed by softening the softenable layers sufficiently to allow migration of the migration material through softenable layer 10 and surface skin 8 and in depth into softenable layer 9.

The term "electrical latent image" is used to describe the latent image in the advantageous system of the present invention and that term and the several variant forms thereof used herein include the images formed by the charged-expose mode. These images cannot be readily detected by standard electromagnetic techniques as an electrostatic latent image, for example, of the type found in xerography, and may be such that no readily detectable or, at best, a small change in the electrostatic potential is found after exposure (when using preferred exposure levels); and include, also, electrostatic latent images of the type similar to those found in xerography which are typically readily measurable by standard electrometers, that is, electrostatic latent images showing surface potentials typically reading at least from about 5 to 10 volts.

Figure 1B:
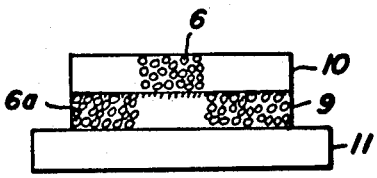
FIG. 1B represents an imaged migration imaging member comprising a first layer of softenable material containing background migration material, i.e., unmigrated migration material, overlying a second layer of softenable material which contains an image, i.e., imagewise migrated migration material, and which also contains a surface skin located at the interface between the first and second layers of softenable material.

FIG. 1B illustrates a developed migration imaging member. FIG. 1B illustrates softenable layer 10 after development containing unmigrated migration material 6, i.e., background material, and softenable layer 9 containing, in image configuration, migrated migration material 6*a*.

Figure 1C:
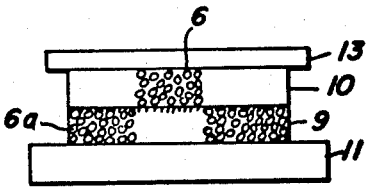
FIG. 1C is a partially schematic drawing representing an imaged member as illustrated in FIG. 1B which additionally contains a stripping member which has been sufficiently adhered to the softenable layer containing the background of migration imaging material that upon removal the member will split at the interface.
Figure 1D:
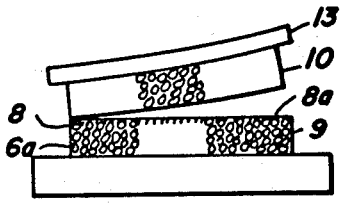
FIG. 1D is a partially schematic drawing representingsplitting the first layer of softenable material from the underlying second layer of softenable material at the interface, i.e., the location of the surface skin.

FIG. 1C illustrates bringing stripping member 13 into sufficient contact with softenable layer 10 so that, as illustrated in FIG. 1D, when stripping sheet 13 is pulled away from member 1, stripping member 13 will strip softenable layer 10 containing background migration material 6 from softenable layer 9 containing image configuration migration material 6*a*. The member will split at interface 8*a* where surface skin 8 is located. Splitting is accomplished, preferably, by contacting the free surface of softenable layer 10 with a solid stripping member, e.g., Mylar, to at least tack stripping member 10 to softenable layer 10 sufficient to split softenable layer 10 from softenable layer 9 when stripping member 10 is pulled away from member 1. Stripping member 13 and softenable layer 9, or if softenable layer 9 resides on a substrate, here shown as substrate 11, are pulled opposite to one another until softenable layer 10, containing background material, i.e., unmigrated migration material, separates, i.e., splits, away from softenable layer 9 which contains the image, i.e., the imagewise migrated migration material. This produces an image with unexpected improved resolution and diffuse contrast density. On convenient mode of contacting a stripping member to an imaging member is to use a stripping sheet of web and pass it with the imaged member in a sandwich configuration through opposed pressure rollers.

Stripping member 13 may be of any suitable material, such as plastics, rubbers or more specifically, Mylar, a polyester film available from E.I. DuPont. Suitable stripping members are more fully disclosed in U.S. Pat. No. 3,741,757.

Figure 1E:
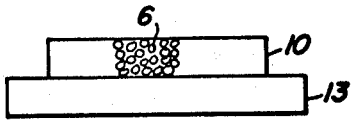
FIG. 1E is a partially schematic drawing representing a portion of the split member comprising the stripping member which is adhered to the layer of softenable material which contains background migration material.

FIG. 1E represents the stripping sheet containing softenable layer 10 which contains unmigrated migration material 6, i.e., background material.

Figure 1F:
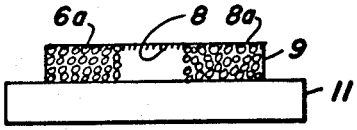
FIG. 1F is a partially schematic drawing representing a portion of the split member comprising the layer of softenable material containing the image, i.e., imagewise migrated migration material.

FIG. 1F illustrates softenable layer 9 which contains the image, i.e., imagewise migrated migration material.

Figure 2A:
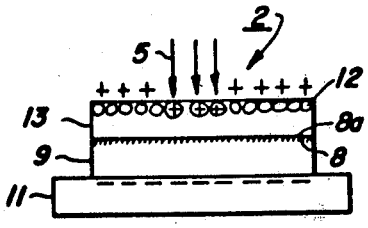
FIGS. 2A–2F are partially schematic drawings representing forming a latent image on a first layer of softenable material containing a layer of migration imaging material which overlies a second layer of softenable material which is substantially devoid of migration material and which contains a surface skin at the interface between the first and second layers of softenable material. The imaging member is developed and a stripping member is applied to the imaged member and then pulled away from the image member thereby stripping the first layer of softenable material containing the background material from the second layer of softenable material containing the image, i.e., the imagewise migration material.

Referring now to FIG. 2A which illustrates a first layer of softenable material 13 which contains a fracturable layer of migration material 12 contacting softenable layer 13 and contiguous the surface of softenable layer 13, i.e., the surface of softenable layer 13 which is opposite the surface which contacts softenable layer 9 at interface 8*a*.

Migration material 12, illustrated as a fracturable layer in FIG. 2A and migration material 6, illustrated in FIG. 1A, may comprise any suitable material selected from an extremely broad group of materials and mixtures thereof, including electrically conductive materials, insulating materials, partially electrically conductive materials, electrically photosensitive materials, photosensitively inert materials, or any other materials having any other suitable physical characteristics. A host of such suitable materials are described in copending application Ser. No. 837,780, filed June 30, 1969, now U.S. Pat. No. 3,975,195.

In FIG. 2A the migration material 12 is arranged in a fracturable layer contacting softenable layer 13 and contiguous the surface of softenable layer 13 which is spaced apart from softenable layer 9, portions of which migrate through softenable layer 13 and interface 8*a* and in depth in softenable layer 9. It is preferred for images of highest resolution, density and utility, that fracturable layer of migration material 12 be a particulate material layer; however, such fracturable layers may also comprise any continuous or semi-continuous, or microscopically discontinuous fracturable layer, which is capable of breaking up into discrete particles of the size of an image element or less during the development, thereby permitting portions of the fracturable layer to migrate through softenable layer 13 and interface 8*a* and in depth in softenable layer 9 in image configuration. When the migration material is arranged in a fracturable layer contacting the softenable material spaced apart from the substrate, such fracturable layers are preferably of thicknesses in the range from about 0.01 to about 2.0 microns, although fracturable layers of thicknesses of about 5.0 microns have been found to give good results in various embodiments. Particle size may preferably be of an average not greater than about 2 microns. More preferably, an optimum range of particle size comprising particles of average not greater than about 0.7 micron.

Migration material used in the present invention will typically not be soluble in solvents and otherwise not adversely reactive with either the softenable material or any other element in the imaging member, as well as any solvent liquid which may be used in the development step in the present invention. Furthermore, substrate 11, softenable layers 9 and 13 and migration material 12, as illustrated in FIG. 2A, are the same as or similar to those materials suitable for use in the imaging member described above in conjunction with FIG. 1A.

In FIG. 2A, a first softenable layer 13 containing a fracturable layer of migration material 12 contiguous and contacting the surface of said first layer of said softenable material 13 and spaced apart from interface 8*a* which is between said first and second layers of said softenable material. The first layer of softenable material 13 overlies a second layer of softenable material 9. Second layer of softenable material 9 contains surface skin 8 located at the interface 8*a* which is between softenable layer 9 and softenable layer 13. Surface skin 8 may comprise the same materials as described for surface skin 8 in FIG. 1A.

Referring now to the process of forming a latent image on imaging member 2, as illustrated in FIG. 2A, member 2 in the preferred mode is electrically latently imaged. Various methods of providing electrical latent images and electrostatic latent images are described in the aforementioned copending applications. A particularly preferred method of providing electrically latent images is the optimum charge-exposed mode wherein the migration material comprises electrically photosensitive material which when substantially uniformly electrically charged and imagewise exposed with activating electromagnetic radiation, forms an electrical latent image corresponding to the imaging exposure. Upon development, the migration material which is typically particulate material, migrates in imagewise configuration and in image densities proportional to the charge densities in the electrical latent image, or when the charge-exposed mode is used , proportional to the amount of exposure to activating electromagnetic radiation. In this way, continuous tone (or half tone) migration images result from the migration imaging system.

In FIG. 2A, the optimum charge-exposed mode of forming an electrical latent image on an imaging member is illustrated. Imaging member 2 is electrically charged with an electrical charging device such as a corotron charging device, which may be passed adjacent the surface of the imaging member. Charged imaging member 2 is shown being imagewise exposed to activating electromagnetic radiation in areas 5. Upon imagewise exposure, the electrically photosensitive material of the present invention apparently undergoes a selective relocation of charge into or within or of the material, said relocation of charge being effected by the activating electromagnetic radiation acting on the bulk or surface of the electrically photosensitive material. This may specifically include photoconductive effects, photoinjection, photoemission, photochemical effects and others which enhance or cause selective relocation of charge in the electrically photosensitive material. After the electrical latent image is applied or even during its application, the latently image member is developed by softening the softenable material sufficient to allow migration of the migration material 12 through softenable layer 13 and interface 8*a,* i.e., surface skin 8, and in depth in softenable layer 9.

Figure 2B:
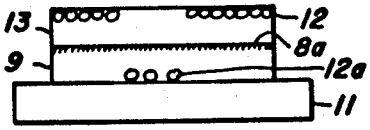

FIG. 2B illustrates a developed migration imaging member of the instant invention. In FIG. 2B the migration imaged member comprising substrate 11 which supports softenable layer 9. Softenable layer 9 contains an image, i.e., imagewise migrated migration material 12*a.* As illustrated, upon development the migration material has migrated in the imagewise exposed areas 5 in image configuration through softenable layer 13 and interface 8*a,* i.e., surface skin 8, and through softenable layer 9 to substrate 11 forming an image of migration material 12 on substrate 11. Overlying softenable layer 9 is softenable layer 13 which contains unmigrated migration material 12, i.e., background material, which is contacting the softenable material and which is contiguous a surface of softenable layer 13 which is opposite the surface contacting softenable layer 9.

Figure 2C:
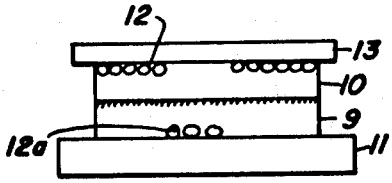
Figure 2D:
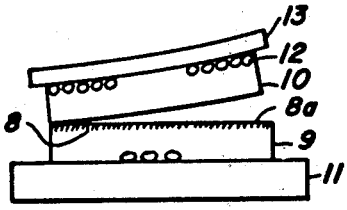

FIG. 2C illustrates bringing a stripping member 13 into sufficient contact with softenable layer 10, so that, as illustrated in FIG. 2D, when stripping member 13 is pulled away from imaging member 2, this will strip away softenable layer 10 at interface 8*a.* Softenable layer 10 contains unmigrated migration material 12, i.e., background material.

Figure 2E:
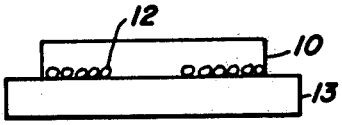

FIG. 2E illustrates stripping sheet 13 which contains softenable layer 10 which contains background migration imaging material 12.

Figure 2F:
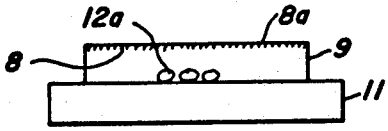

FIG. 2F illustrates softenable material 9 containing an image, i.e., imagewise migrated migration material 12*a,* which is substantially free of any background material. Softenable material 9 is illustrated overlying substrate 11.

FIG. 3 illustrates imaging member 3 which comprises softenable layer 14 which contains a dispersion of migration material 6 in softenable material 7. Softenable layer 14 also contains surface skin 8 which is located at the interface 8*a* between softenable layer 14 and softenable layer 15 which underlies softenable layer 14 and is substantially free of migration material. The member 3 illustrated in FIG. 3 is substantially the same member as illustrated in FIG. 1A except that softenable layer 14 contains surface skin 8 whereas in FIG. 1A the surface skin 8 is contained by softenable layer 9.

FIG. 4A illustrates softenable material 16 which contains a fracturable layer of migration material 12 contacting and contiguous one surface of softenable layer 16 which is opposite the interface between softenable layer 16 and an underlying layer of softenable material 16. Softenable layer 16 also contains a surface skin at the interface 8*a* between softenable layer 16 and an underlying softenable layer 17. Softenable layer 17 is substantially free of any migration material.

The following examples further specifically define the present invention. The parts and percentages are by weight unless otherwise indicated. All exposures are from a tungsten filament light source, unless otherwise specified.

EXAMPLE I

Imaging members, as illustrated in FIG. 1A, are prepared. The softenable layer which is essentially devoid of migration material in this example comprises a 50/50 by weight mixture of Piccotex 100, a copolymer of alpha-methyl styrene and vinyl toluene, available from Pennsylvania Industrial Chemical Co. and MA-140, a copolymer of styrene and n-butyl-methacrylate in a 65/35 blend by weight. This solution is gravure coated onto an aluminized Mylar (a polyester film available from E. I. DuPont) substrate and allowed to dry to a thickness of 2 microns. This layer is then treated by exposing the layer to ultraviolet radiation from a Hanovia H high pressure quartz mercury vapor arc lamp (available from the Hanovia Lamp Division of Englehard Industries) for about 5 minutes. The lamp is held about 5 inches from the sample. The thickness of the surface skin on a layer treated with ultraviolet light for about 5 minutes, is measured by the method described in copending application Ser. No. 388,323, filed Aug. 7, 1964, now abandoned, and found to be about 0.15 microns thick.

A softenable layer in this example which comprises migration material dispersed throughout the softenable material is prepared as follows: The softenable material was prepared in a two-part mixture which is as follows: Part one comprises 2.7 grams of x-form metal-free phthalocyanine prepared as disclosed in copending application Ser. No. 505,723, filed Oct. 29, 1965, now U.S. Pat. No. 3,357,989, and 4.0 grams of Nirez 1085, a polyterpene copolymer (available from Tenneco Chemical Corp., Newport Division), mixed with 10.7 grams of Sohio 3440 (an odorless solvent). Part two of the mixture is prepared by mixing 7.5 grams cadmium sulfoselenide with 2.5 grams of Nirez 1085, a polyterpene copolymer (available from Tenneco Chemical Corp., Newport Division) and 7.5 grams Sohio 3440 (an odorless solvent).

Both part one and part two mixtures are ground separately in a stainless steel ball mill with stainless steel balls with ¼ inch diameter until completely mixed. Part one and part two are then blended together in a 50/50 blend by volume. This solution is coated by drawing down the solution with a Mayer rod onto the layer of softenable material, which is devoid of migration material and overlies the aluminized Mylar substrate, to a dry thickness of about 2 microns.

The member is charged to positive 4000 volts on a grounded plate. The member is then exposed to 1 f.c.s. (foot-candle-second) tungsten lamp with a color temperature of 3400° K. The member is then developed by exposing the member to vapors of 1,1,1-trichloroethane for about 20 seconds. As a result, the migration material in the top layer of the softenable material in the unexposed areas migrates through the top layer of softenable material and interface and in depth in the bottom layer of softenable material, i.e., the softenable material which was originally devoid of migration material. Splitting the member is accomplished by pressing (outside of the vapor development chamber, in air) the imaged member against a stripping member of pressure sensitive adhesively coated Mylar which is gently pressed against the top surface, i.e., free surface, of the softenable material, followed by pulling the Mylar stripping member and the imaged member apart. The split image has Diffuse Contrast Density (Macbeth) of 1.59; a background density (Macbeth) of 0.17 and resolution of 80 line pairs/mm.

EXAMPLE II

Example I is followed except the first layer of softenable material which is coated onto the aluminized Mylar strip is not exposed to ultraviolet radiation. Otherwise the member is fabricated by using the same methods and materials and split by the same process. The results is that the image produced had a Diffuse Contrast Density (Macbeth) of 1.13 and a background density (Macbeth) of 0.17 and a resolution of 60 lines pairs/mm.

An unexpected increase in Diffuse Contrast Density of 28% and an increase in resolution of 25% was obtained.

What is claimed is:

1. An imaging method comprising:

a. providing an imaged member comprising:

a first layer of electrically insulating softenable material containing a background of migration material, said first layer of softenable material overlying a second layer of electrically insulating softenable material, said second layer of softenable material containing migration material distributed in depth in said second layer of softenable material in image pattern configuration, at least one of said layers of softenable material containing a surface skin located at the entire surface of at least one of said softenable layers and at the interface between said layers of softenable material, said surface skin formed by exposing said surface of at least one of said layers of softenable material to hardening radiation sufficient to form said surface skin having a thickness from about 0.1 to about 0.5 micron;

b. removing said background of migration material by splitting said member at said interface.

2. The method according to claim 1 wherein the surface skin is from about 0.01 to about 0.2 micron thick.

3. The method according to claim 1 wherein said removing step (b) comprises the steps of:

c. providing a stripping member capable of splitting said imaged member;

d. bringing said stripping member into tackified contact with said member; and e. separating said stripping member and said imaged member thereby splitting said imaged member at said interface between said first and second layers of softenable material.

* * * * *